United States Patent [19]

Horan et al.

[11] Patent Number: 4,920,781

[45] Date of Patent: May 1, 1990

[54] VEHICLE REPAIR RACK SYSTEM

[75] Inventors: Gerald P. Horan, Markham; John T. Wickmann, Omemee; Stanislaus McNamee, Oshawa, all of Canada

[73] Assignee: Chart Industries Ltd., Ontario, Canada

[21] Appl. No.: 183,646

[22] Filed: Apr. 19, 1988

[51] Int. Cl.[5] ..... B21D 1/12

[52] U.S. Cl. ..... 72/447; 72/705

[58] Field of Search ..... 72/705, 447

[56] References Cited

U.S. PATENT DOCUMENTS

| | | | |
|---|---|---|---|
| 1,907,925 | 5/1933 | Wochner | 72/705 |
| 3,777,541 | 12/1973 | Whitney | 72/705 |
| 3,835,693 | 9/1974 | Majersky | 72/705 |
| 4,023,394 | 5/1977 | Borup | 72/705 |
| 4,151,737 | 5/1979 | Specktor | 72/705 |
| 4,291,570 | 9/1981 | Whitney | 72/705 |
| 4,530,232 | 7/1985 | Smith | 72/705 |
| 4,658,627 | 4/1987 | Brewer | 72/705 |
| 4,761,984 | 8/1988 | Fuscaldo | 72/705 |

FOREIGN PATENT DOCUMENTS

| | | | |
|---|---|---|---|
| 2145992 | 3/1973 | Fed. Rep. of Germany | 72/705 |
| 2246883 | 4/1974 | Fed. Rep. of Germany | 72/705 |
| 2420248 | 11/1975 | Fed. Rep. of Germany | 72/705 |

OTHER PUBLICATIONS

Nike Hydraulic Dataliner Catalog No. 164 E, Nike Hydraulic Inc., Itasca, Ill., Sep. 1980.

*Primary Examiner*—Robert L. Spruill

*Attorney, Agent, or Firm*—Weingarten, Schurgin, Gagnebin & Hayes

[57] ABSTRACT

A rack for use with automotive bodies, has a substantially rigid frame of welded steel sections to receive an automotive body in secured relation on the rack in supported space relation above a floor surface. The rack has a series of depending flanged shear members extending beneath it, onto which a tiltable thrust plate, that forms a nose portion of an elongated trolley, can be attached. The trolley nose portion is pushed against a flange, to mount it, and bear against the respective rack shear member. The trolley forms part of a loading system, the trolley having a detachable upstanding tower portion from which a racking chain or chains can be secured to the automotive body, the tower including jacking provisions by which deforming tension forces can be applied by way of the chain between the tower and the body. The trolley has a spring-loaded rear wheel suspension, which permits it to accommodate to irregular floor surfaces. The trolley is substantially self stabilizing in jamming relation against the underside of the rack.

11 Claims, 6 Drawing Sheets

VEHICLE REPAIR RACK SYSTEM

FIELD OF THE INVENTION

This invention is directed to an automotive body rectifying system, and in particular to a system for applying racking forces in pulling, corrective relation against an automotive body.

BACKGROUND TO THE INVENTION

In the automotive repair industry there are well established systems for repairing and aligning vehicles, including trucks and automobiles. The systems include provisions for body straightening by the selective application of tension racking forces to provide rectification, including collision damage. The application of such forces requires precise positioning of the racking mechanisms with the capability to readily relocate and reposition the racking means in relation to a racking frame upon which a subject body is secured. One earlier approach to the positioning of a pulling racking frame involves the provision of a trolley mounted pulling tower, the trolley having a locating bracket at the front end thereof for pinning attachment to an intermediate bracket which, in turn is removably attached to selected ones of a series of pin apertures provided on frame cross members, and on the periphery of the racking frame. The application of racking tensile forces against the vehicle body brings the trolley into compressive, load transfer relation with the racking frame.

The setting up and necessary continued readjustments of this type of prior arrangement is time consuming, labour intensive and very fatiguing for a body man who is occupied full time in using such apparatus. Thus, a heavy trolley having a somewhat massive pulling tower requires to be released from its anchor pin, connecting it with an anchor bracket, and a pair of close fitting shear pins connecting the anchor bracket with the racking frame also released; relocation of trolley and tower to another location relative to the racking frame is then required, with precise realignment of the bracket on the frame at the new location, including aligning the trolley attachment bracket with another pair of racking frame attachment apertures, and reattachment of the trolley to the bracket by the insertion of the nose of the trolley in engaging relation with the bracket, and insertion of the anchor pin in securing relation between the bracket and the trolley. Owing to the massive nature of the apparatus involved such an operation generally of necessity requires two men, in order to effect trolley repositioning and reattachment. Furthermore, repositioning of the bracket on one of the frame cross members can readily involve a great deal of time-consuming manipulation.

SUMMARY OF THE INVENTION

The present invention provides a racking system, having a racking frame for use with a wheeled attachment trolley, the frame having a plurality of cylindrical load transfer shear members in predetermined spaced relation depending therebeneath, in use to receive a trolley thrust plate in centred, thrust transfer relation therewith.

The cylindrical shear members each has a laterally extending cam plate secured to the bottom thereof in downwardly spaced relation from the racking frame. Racking frame support means position the frame in spaced relation above a supporting floor surface, to locate the respective cam plates a predetermined distance above the floor surface.

The noted cam plates, in the preferred embodiment are of substantially circular planform i.e., as viewed from above, having a chamfered edge portion about the upper peripheral edge thereof, in use to receive a reverse chamfered nose portion of the trolley plate in guiding, upwardly deflecting relation thereon.

The wheeled attachment trolley of the preferred embodiment of the present system has a pivotted thrust transfer plate mounted upon a laterally extending king pin, about which the thrust transfer plate has a limited angle of tilting displacement, to facilitate mounting of the trolley thrust plate upon the frame cam plate. Ia the mounted condition a pair of unsprung forward wheels of the attachment trolley are raised upwardly from off the floor.

The tilting provision of the trolley king pin and thrust plate permits the rear of the trolley to raise upwardly into joining relation against the under surface of the racking frame upon the application of racking tension loads by an upwardly extending tower portion mounted on the trolley.

In the system preferred embodiment the subject trolley has a detachable tower secured by a pivot pin to a pair of tower attachment lugs, extending rearwardly of the trolley.

The trolley has a pair of sprung rear wheels, resiliently secured to the trolley, the compression spring suspension facilitating handling of the trolley. The location of the trolley thrust plate forwardly of the front wheels of the trolley enables the thrust plate to be raised upwardly, in response to downward displacement of the rear of the trolley on its springs. This facilitates engagement of the trolley thrust plate with the cam surfaces of a selected one of the racking frame cam plates.

BRIEF DESCRIPTION OF THE DRAWINGS

Certain embodiments of the invention are described, reference being made to the accompanying drawings, wherein.

DETAILED DESCRIPTION OF THE EMBODIMENTS OF THE INVENTION

Figure 1:
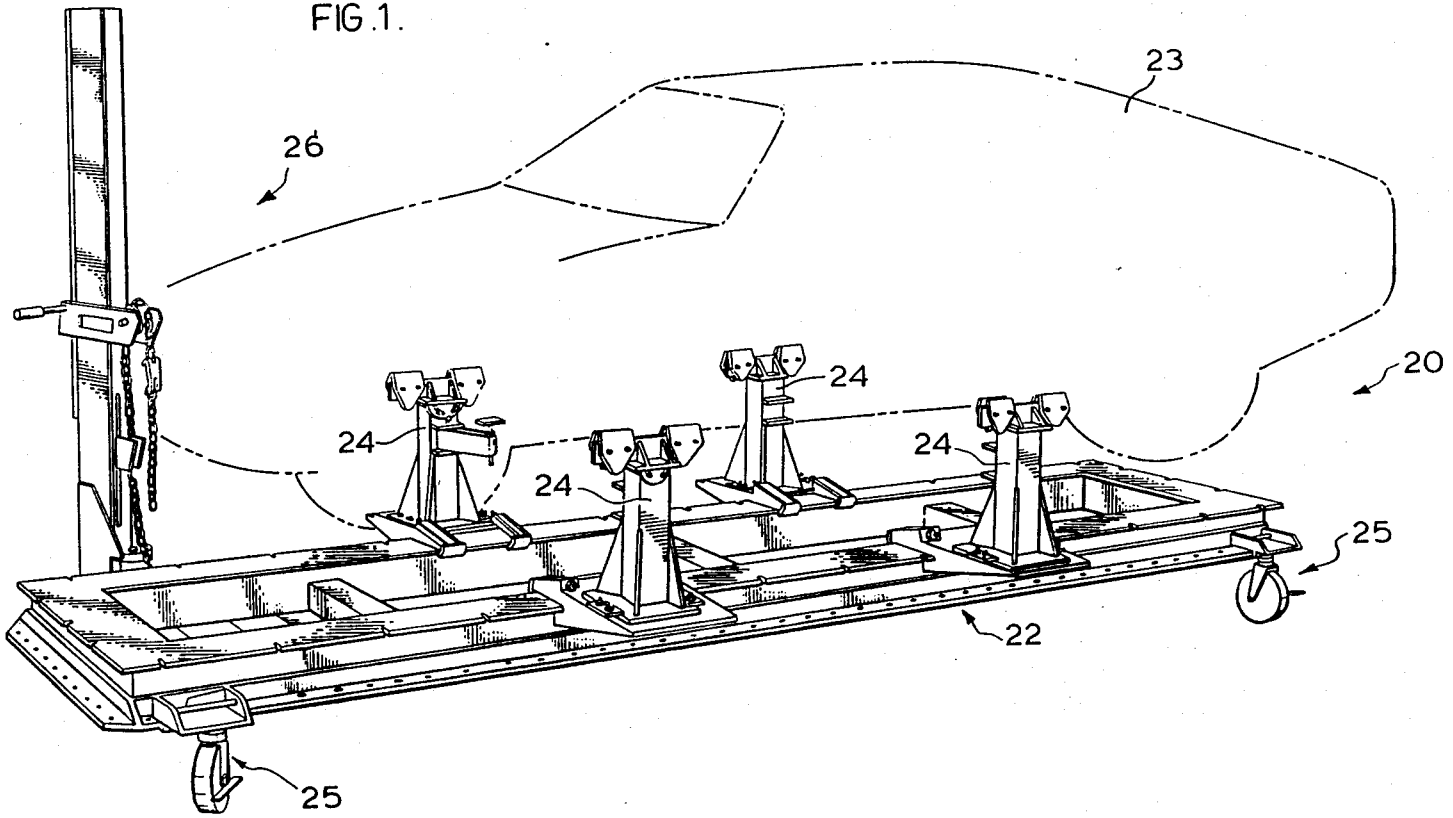
FIG. 1 is a general view of the subject system, incorporating a wheeled racking frame and showing in phantom an automobile mounted thereon.

Referring first to FIG. 1 the system 20 has a racking frame 22 with four pedestals 24 having a vehicle 23 mounted thereon. The vehicle 23, illustrated in phantom is an automobile, but could equally well be a truck.

The frame 22 is shown mounted upon castoring wheel assemblies 25.

A trolley mounted racking tower 26 is shown in secured relation with the racking frame 22.

Figure 3:
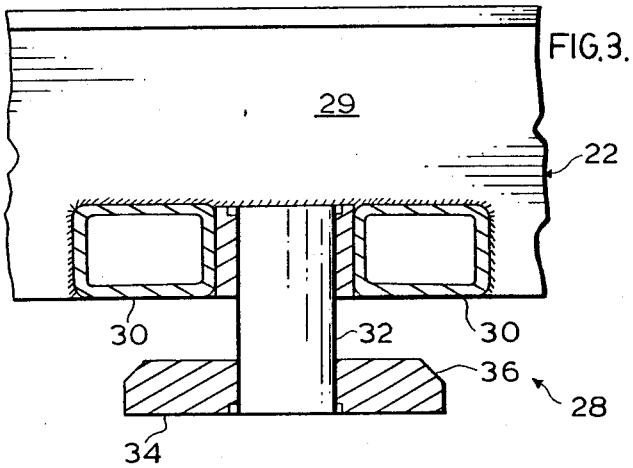
FIG. 3 is an enlarged side elevation detail in diametrical section of a frame shear member and associated cam plate.
Figure 2:
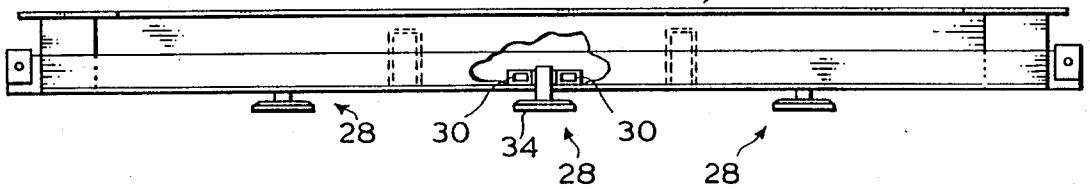
FIG. 2 is a side elevation of the subject racking frame.

Referring to FIGS. 2 and 3, the racking frame 22 has three transverse beam assemblies 28, each assembly 28 comprising a pair of structural members 30 secured at their ends and extending between side members 29 of the frame 22.

Each pair of members 30 has a pair of cylindrical shear members 32 secured therebetween, to provide an assembly of six spaced apart load transfer points beneath the frame 22. Each shear member 32 has a circular cam plate 34 secured thereto, having a chamfered upper peripheral edge portion 36, to serve as a cam guiding surface for 360° of the periphery of the shear member 32.

Figure 4:
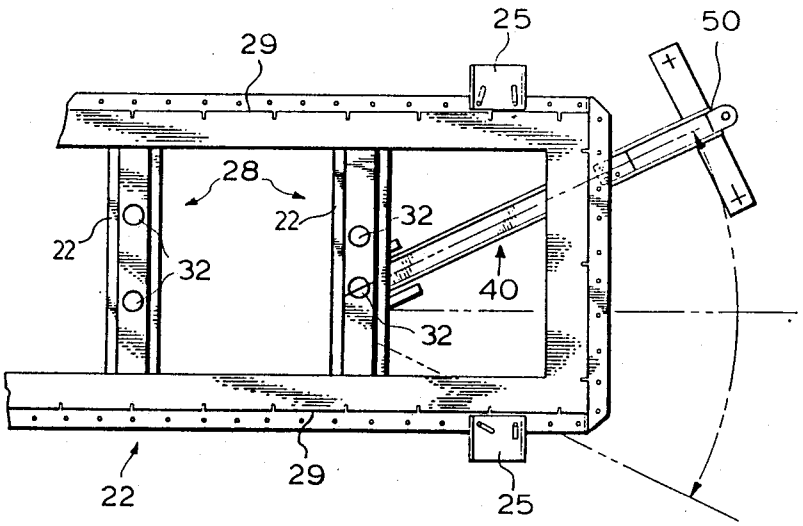
FIG. 4 is a plan view showing a subject trolley in engaged relation with the racking frame.

Referring to FIG. 4 the illustrated right hand portion of frame 22 has two transverse beam assemblies 28, each having a pair of shear members 32. Wheel assemblies 25 are attached in pinned relation to the frame 22.

A trolley 40 in inserted underlying relation to frame 22 is shown inserted in attached relation to one of the shear members 32.

Figure 7:
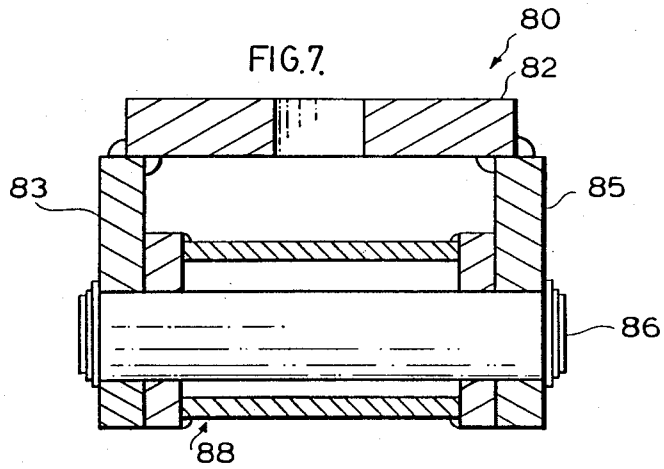
FIG. 7 is a section view taken at 7—7 of FIG. 6 and appears with FIGS. 2 and 3.
Figure 5:
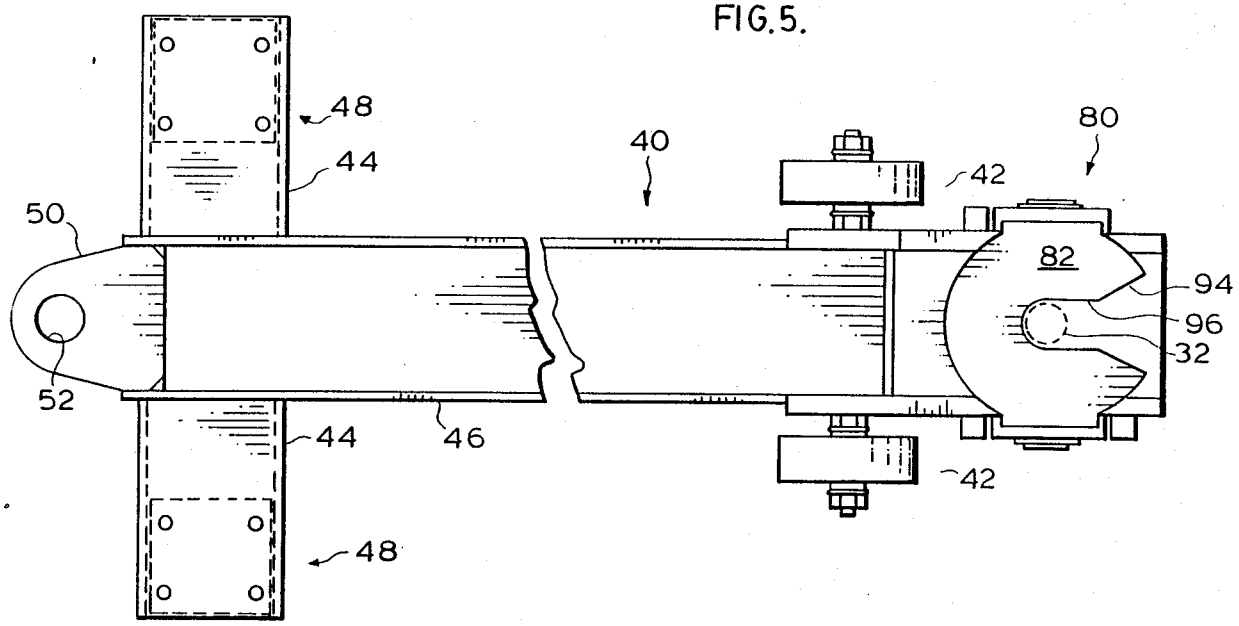
FIG. 5 is a shortened plan view of a subject trolley.
Figure 6:
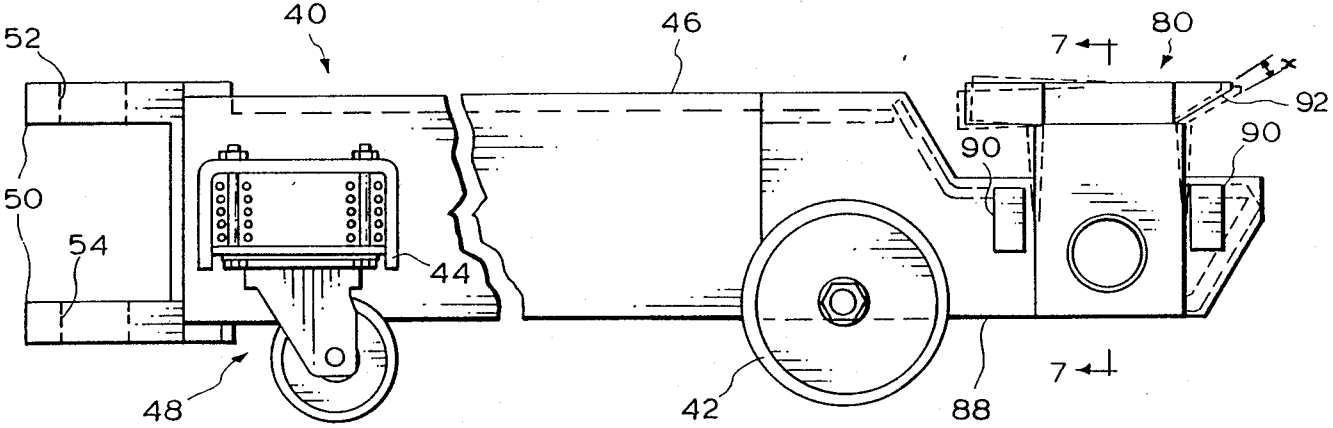
FIG. 6 is a corresponding shortened side elevation of the subject trolley.

Referring to FIGS. 5, 6 and 7, the trolley 40 has a pair of front wheels 42 mounted transversely thereof on a fixed axle.

An outrigger arm 44 extends laterally on each side of a central body member 46. Each arm 44 carries a spring loaded castoring wheel assembly 48. At the rear of the trolley 40, adjacent the outrigger arms 44 is located a pair of tower attachment lugs 50 having aligned passages 52, 54 therein to receive a pivot pin 56 (see FIG. 8) inserted therein.

At the front end (right hand, as illustrated in FIG. 5) of the trolley 40 the trolley thrust means 80 is located. The thrust means 80 comprises a thrust plate 82 secured to side plates 83, 85 and mounted on king pin 86. The king pin 86 is carried by a nose portion 88 of the trolley 40. Two pairs of stop pads 90 secured to trolley nose portion 88 limit to a few degrees (X) the degree of freedom to tilt, of the thrust means 80 about king pin 86.

The thrust plate 82 has a tapered nose portion 92, having a Vee'd entry 94 and a recess 96 to receive a sheer member 32 (shown in phantom) in entered relation therein.

Referring to FIGS. 3 and 6, in operation the tapered nose portion 92 of thrust plate 82 engages the chamfered edge cam surface 36 of cam plate 34 so that the thrust means 80 tilts upwardly, and the thrust means 80 mounts the cam plate 34, to engage the shear member 32 in load transfer relation therewith. This action generally raises the trolley front wheels 42 clear of the ground surface.

Figure 8:
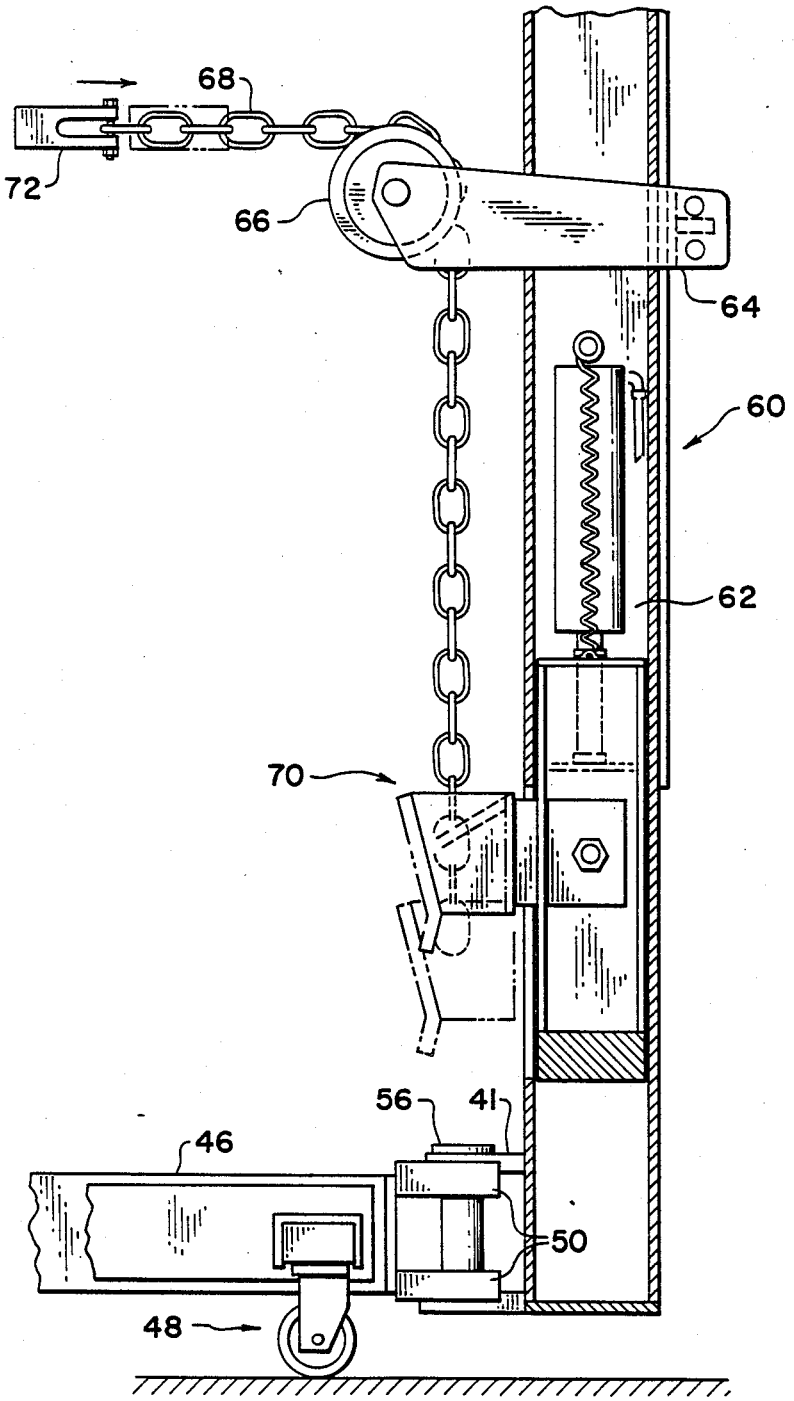
FIG. 8 is a schematic side view of a portion of the trolley of FIGS. 5 and 6 having a racking tower mounted thereon.

Referring more particularly to FIG. 8 a racking tower 60 is secured by pivot pin 56 to the trolley 40.

The tower 60 has a hydraulic jack-type actuator 62 therein for displacing chain trap 70 in downward driven relation, to draw a racking chain 68 rearwardly over pulley 66. The racking chain 68 is releasably secured to the chain trap 70, and has a quick release 72 at its other end for attachment to a pulling device, (not shown). The pulley 66 is stationary during the application of pulling force by actuator 62.

In operation, with the trolley thrust plate 82 engaging a suitably located shear member 32 of the racking frame 22, a racking chain 68 is secured to the vehicle 23 by attachment means, (not shown) at a point to be tension loaded. The slack in chain 68 is initially taken up in the chain trap 70, by simple manual manipulation. Upon pressurization of jack-type actuator 62 the pulley 68 moves upwardly, causing the chain 68 to tension. This tensioning of chain 68 moves the tower 60 and loads trolley 40 into heavier engagement with the engaged shear member 32 of frame 22, and also applies a forward toppling bending moment to tower 60. This bending moment, fulcrummed about shear member 32 and cam plate 34, causes tower 60 and trolley 40 to incline inwardly towards the vehicle 23. This brings the top surface of trolley 40 into upward jamming relation with the under surface of racking frame side or end members 29, to provide transverse stabilization to the trolley 40 and tower 60. The limited freedom of thrust means 80 to tilt suffices to permit this upward displacement of trolley 40. At the same time, the permitted limited degree of tilt of thrust means 80 precludes the thrust means 80 from canting to an inoperable position, when being attached to the racking frame 22, as described above.

It will be seen that as many as six racking towers 60 can be mounted at one time to a racking frame 22 in pulling relation with a vehicle mounted on frame 22.

What is claimed:

1. A racking frame for applying rectification forces to a vehicle body by means of separable trolley mounted racking towers, each racking tower being mounted on an elongated wheeled trolley having a substantially horizontal body portion with a free end remote from said tower;

said racking frame comprising a plurality of spaced apart first rigid members defining a rack of regular geometry;

said rigid members further defining upper and lower surfaces of said frame;

a plurality of rigid load transfer members connected to said first rigid members in a downwardly extending spaced apart relationship beneath the underside of said frame, each rigid load transfer member comprising a rigid post extending substantially vertically and a cam plate extending horizontally from adjacent the bottom of said post, said cam plate having an inclined upper surface thereof defining a cam surface engageable with said trolley free end to urge said trolley upwardly into wheel-on load transfer engagement with said load transfer member.

2. A racking frame as set forth in claim 1, including support means extending downwardly from said frame to support the frame in spaced relation above a supporting floor surface, to position said plate a predetermined distance above the floor surface.

3. The racking frame as set forth in claim 1 in combination with said trolley and said trolley mounted racking tower, said free end of said trolley body portion having a nose portion, and thrust plate means supported thereon to receive said rigid post in thrust transfer relation therewith.

4. The racking frame as set forth in claim 3, said horizontally extending plate being of substantially circular shape as viewed from above, and having said cam surface extending at least about the upper peripheral edge thereof to urge said nose portion and said trolley thrust plate into engagement with said rigid post.

5. The combination as set forth in claim 3, wherein said trolley thrust plate means has a cam surface to mount said cam plate and bring said thrust plate means into centered thrust transfer relation with said load transfer member.

6. The combination as set forth in claim 5, wherein said trolley thrust plate means is tiltably secured to said trolley to facilitate mounting of the thrust plate means on said cam plate.

7. The combination as set forth in claim 3, said trolley mounted tower having attachment means thereon to receive a racking chain in secured, tension adjustable relation therewith.

8. The combination as set forth in claim 3, wherein said trolley includes a pair of forward floor contacting support wheels located adjacent said free end, in use to facilitate movement of said trolley across the floor into engaging relation with said load transfer member.

9. The combination as set forth in claim 8, wherein said trolley thrust plate means is positioned at a predetermined height above said floor to engage said frame cam plate, and to raise said forward wheels upwardly from said floor on engagement of said trolley free end with said plate.

10. The combination as set forth in claim 8, said trolley having a pair of rear wheels secured in spring mounted relation thereto adjacent said racking tower, to facilitate movement of the trolley, said trolley thrust plate means being located on the side of said forward support wheels remote from said racking tower, whereby, in use, downward displacement of the trolley on said spring mounted rear wheels raises the thrust plate means, to facilitate mounting of said thrust plate on said plate cam surface.

11. The combination as set forth in claim 10, said thrust plate means being mounted forwardly of said forward support wheels, on the side thereof remote from said rear wheels, to raise said thrust plate upwardly upon downward compression of said trolley on said spring mounted rear wheels.

* * * * *